US005711783A

United States Patent [19]

Schloh

[11] Patent Number: 5,711,783

[45] Date of Patent: Jan. 27, 1998

[54] PREPARATION FROM METAL ALKOXIDES OF HIGH PURITY METAL POWDER

[75] Inventor: Martin Schloh, Köln, Germany

[73] Assignee: H.C. Starck, GmbH & Co., KG, Goslar, Germany

[21] Appl. No.: 678,095

[22] Filed: Jul. 11, 1996

Related U.S. Application Data

[63] Continuation of Ser. No. 373,592, Jan. 17, 1995, abandoned.

[30] Foreign Application Priority Data

Feb. 15, 1994 [DE] Germany ..... 44 04 747.9

[51] Int. Cl.[6] ..... B22F 9/22

[52] U.S. Cl. ..... 75/362; 75/365; 75/369

[58] Field of Search ..... 75/343, 351, 362, 75/365, 369, 371; 205/455

[56] References Cited

U.S. PATENT DOCUMENTS

| | | | |
|---|---|---|---|
| 3,640,093 | 2/1972 | Levene et al. | 65/17.2 |
| 3,730,857 | 5/1973 | Tripp | 205/455 |
| 4,582,696 | 4/1986 | Crosbie | 423/344 |
| 4,615,736 | 10/1986 | Armor et al. | 75/365 |
| 4,636,248 | 1/1987 | Ogata et al. | 75/351 |
| 4,755,369 | 7/1988 | Yoshiharu | 75/369 |

FOREIGN PATENT DOCUMENTS

| | | |
|---|---|---|
| 0 197 271 | 10/1986 | European Pat. Off. . |
| 63-184306 | 7/1988 | Japan . |

OTHER PUBLICATIONS

Patent Abstracts of Japan, Unexamined Applications, M. Field, vol. 14, No. 177, 9 Apr. 1990, p. 124 M 960, JP–A–02 030 706 (Central Glass Co. LTD).

Chemical Abstracts, vol. 98, No. 26, 27 Jun. 1983, p. 311, col. 2, No. 22077lr, JP–A–57 175 724 (Jpn. Kokai Tokkyo Koho) entitled "High–purity aluminum silicate powder".

Chemical Abstracts, vol. 112, No. 2, 8 Jan. 1990, p. 222, col. 1, No. 11077n, JP–A–01 197 311 (Jpn. Kokai Tokkyo Koho) entitled "Preparation of silica–alumina powder for ceramics".

Chemical Abstracts, vol. 76, No. 16, 17 Apr. 1972, p. 219, col. 1, No. 88 962t, JP–A–71 012 898 entitled "Pure molybdenum microparticles".

Chemical Abstracts, vol. 112, No. 26, 25 Jun. 1990, p. 232, col. 1, No. 239106g, Nisshin Seiko Giho 1989 61, 90–9 (Japan) entitled "Production of ultra–fine metal powders by arc plasma".

Chemical Abstracts, vol. 113, No. 26, 24 Dec. 1990, p. 274, col. 1, No. 235978r, JP–A–02 008 304 (Jpn. Kokai Tokkyo Koho) entitled "Manufacture of tungsten powders".

Chemical Abstracts, vol. 94, No. 20, 18 May 1981, p. 224, col. 2, No. 160375v; *J. Powder Bulk Solids Technol.* 1979 3(3), 15–20, entitled "Preparation of metal powders of Groups VI and VIII (iron, cobalt, nickel) by the vapor phase reduction of their ch;lorides pure or in binary mixtures".

Chemical Abstracts, vol. 96, No. 16, 19 Apr. 1982, p. 266, col. 1, No. 126905z; *Redk. Met. Splavy Monokrist. Strukt. (Mater. Vses. Sovehch Monokrist. Tugoplavkikh Redk. Met.)* 9th 1978 (Pub. 1981) 25–30, entitled "Analysis of raw material for the production of highly pure molybdenum and Mo alloys, free from interstitial impurities".

Chemical Abstracts, vol. 106, No. 18, 4 May 1987, p. 202, col. 2, No. 141584n, JP–A–61 201 707 (Jpn. Kokai Tokkyo Koho) entitled "Manufacture of high–purity molybdenum and tungsten powder".

Chemical Abstracts, vol. 111, No. 6,7 Aug. 1989, p. 183, col. 1, No. 42324z, JP–A–01 073 009 (Jpn. Kokai Tokkyo Koho) entitled "Highly–pure tantalum or niobium powder preparation".

Chemical Abstracts, vol. 112, No. 18, 30 Apr. 1990, p. 256, col. 2, No. 162546r, JP–A–01 168 827 (Jpn. Kokai Tokkyo Koho) entitled "High–purity chromium by reduction of oxide powder with hydrogen".

Chemical Abstracts, vol. 105, No. 22, 1 Dec. 1986, p. 247, col. 1, No. 195052k, Nippon Tungsten Rev. 1986, 19, 40 entitled "New tungsten powder of high purity".

Chemical Abstracts, vol. 85, No. 19, 8 Nov. 1976, p. 538, col. 1, No. 143242w, *Proc. Int. Conf. Coord. Chem.*, 16th 1974, 2.1b, 2 pp. entitled "New metallo–organic compounds of molybdenum and tungsten".

*Primary Examiner*—George Wyszomierski
*Attorney, Agent, or Firm*—Jerry Cohen

[57] ABSTRACT

Process for preparing high purity metal powder by reacting one or more volatile alkoxide compounds with a reducing gas.

11 Claims, No Drawings

PREPARATION FROM METAL ALKOXIDES OF HIGH PURITY METAL POWDER

This is a continuation of application Ser. No. 08/373,592, filed Jan. 17, 1995, now abandoned.

BACKGROUND OF THE INVENTION

The present invention relates to a process for preparing high purity metal powder.

The microfabrication of large scale integrated electronic components is making ever greater demands on the purity of the interconnect metals such as, for example, titanium, niobium, tantalum, molybdenum or tungsten. In particular the radioactive elements thorium and uranium can, as α-emitters, give rise to serious defects in large scale integrated memory chips.

In Semiconductor Materials and Process Technology Handbook for Very Large Scale Integration (VLSI) and Ultra Large Scale Integration (ULSI), Gary E. McGuire, Editor, Noyes Publications, pages 575–609 and in Silicon Processing for the VLSI Era, Lattice Press, pages 384–406, there are surveys of the conventional demands as regards electrical conductivity and temperature resistance of the interconnect metals. Because the number of interconnections required and also the average length of the interconnect between the active circuit elements rise with increasing integration density, ever greater demands as regards purity are being made on the interconnect metals. These metals are for the most part applied by sputtering or evaporation.

According to N. N. Greenwood and A. Earnshaw, Chemistry of the Elements, Pergamon Press, 1984, page 1113, the van Arkel and de Boer process is known for the preparation of high purity titanium. In this process the crude titanium to be purified is heated together with iodine to about 500° C. in an evacuated vessel with the formation of gaseous titanium iodide, which in turn undergoes decomposition along a tungsten wire electrically heated to about 1200° C. at another position in the apparatus to give high purity titanium. A disadvantage of the process is that only small quantities can be produced in this way and a series of further elements such as, for example, zirconium, hafnium and above all also thorium can be converted in like manner.

According to the prior art for the production of tantalum metal described in the Kirk-Othmer Encyclopedia of Chemical Technology, Volume 22, Third Edition, pages 541–564, possible alternative processes for producing the pure metal are purification by fractional crystallization and purification by liquid phase extraction. The principle of liquid phase extraction is based on the differing solubility of the metal fluorides in a two-phase system comprising dilute acid and an organic phase, for example, methyl isobutyl ketone. The separation of tantalum and niobium in this way is described in U.S. Pat. No. 3,117,833.

A separation and purification of the desired metal can also be carried out via ion-exchange resins in the manner described in Metallurgy of the Rarer Metals, Volume 6, Tantalum and Niobium, pages 129–133.

A separation by distillation via the metal halides, for example, tungsten hexafluoride, is in principle also possible. This method is the subject matter of Japanese Patent Application 02 30 706. Tungsten hexafluoride is reduced by hydrogen at 650°–1400° C. to give tungsten powder, which is suitable for the production of sputtering targets. The disadvantage of this process is that a large quantity of hydrogen fluoride is formed in the course of the reduction by hydrogen.

The object of the present invention is therefore to provide a process for preparing high purity metal powder which can be carried out easily and economically.

SUMMARY OF THE INVENTION

The present invention provides such a process by reacting volatile, hence sublimable and distillable, metal alkoxides with a reaction gas.

The metal alkoxide compounds used according to the invention have the general formula $M(OR)_x$, wherein M is a metal from the groups 3–14 (according to IUPAC 1985), R is an alkyl, aryl, cycloalkyl or aralkyl radical and $M(OR)_x$ is a sublimable or distillable compound. Several alkoxide compounds which are suitable according to the invention are shown by way of example in the following Table 1.

TABLE 1

| Metal alkoxide | Boiling point |
|---|---|
| Aluminium isopropylate | 128° C./5 mbar |
| Chromium (IV) tert. butylate | 66° C./3.6 mbar |
| Gallium ethylate | 185° C./0.7 mbar |
| Niobium methylate | 153° C./0.13 mbar |
| Niobium ethylate | 156° C./0.07 mbar |
| Tantalum methylate | 130° C./0.3 mbar |
| Tantalum ethylate | 146° C./0.2 mbar |
| Titanium ethylate | 104° C./1.3 mbar |
| Tungsten methylate | 90° C./0.5 mbar |

DETAILED DESCRIPTION OF PREFERRED EMBODIMENTS

Chromium tert butoxide, niobium methoxide, niobium ethoxide, tantalum methoxide, tantalum ethoxide, tungsten methoxide and tungsten ethoxide are particularly preferred according to the invention.

The reaction gas in the reaction according to the invention is preferably hydrogen. The reaction gas may also be rarefied by means of an inert carrier gas, particularly argon.

The process according to the invention is carried out preferably at a temperature of between 400° C. and 1400° C. The reaction temperature particularly preferred is between 600° C. and 1200° C.

To prepare the high purity metal powder, it is useful to purify the metal alkoxide by distillation or sublimation in a PVDF apparatus and then to carry out the reduction in the stream of hydrogen. In this way the impurities which occur as a result of operating in glass apparatus such as, for example, aluminium, calcium, magnesium and silicon, are contained at less than 0.5 ppm.

In preparing the metal alkoxides, attention should be paid to the fact that the conventional process of alkoxide synthesis from metal chloride and alcohol in the presence of a base, which is described, for example, for the preparation of tantalum alkoxides in J. Chem. Soc., 1955, pages 726–728, always leads to compounds containing chloride. Other alkoxides such as, for example, the tungsten alkoxides, are not accessible at all by this method of synthesis.

According to Z. Anorg. Chem. 1932, 206, 423, the conventional process for the synthesis of alkoxide from metal chloride and alcohol in the presence of ammonia is unsuitable for tungsten(VI) alkoxide, because $WCl_6$ reacts directly with ammonia to form a tungsten nitride.

According to Angew. Chem. Int. Ed. Engl. 1982, 94, 146–147, $WF_6$ is converted to $W(OCH_3)_6$ in an equilibrium reaction with volatile $Si(OCH_3)_4$ as ligand carrier. The complete methoxylation is successfully achieved, however, only by treating the partly fluorinated product with a methanolic solution of $NaOCH_3$.

It is known from Inorg. Chem. 1977, 16, 1794–1801, that tungsten(VI) alkoxides can be prepared from the reaction of tungsten(VI) hexakis(dimethylamide) and the corresponding alcohol. However, the synthesis of the tungsten amide compound according to Inorg. Chem. 1977, 16, 1791–1794 is very costly and is therefore ruled out as a large-scale process.

The processes most suitable for preparing tungsten alkoxides in particular, but also of the alkoxides of other metals of the groups 3 to 14 (according to IUPAC 1985) are, electrochemical processes according to U.S. Pat. No. 3,730,857 and Journal of General Chemistry of the USSR (translation of Zhurnal Obshchei Khimii) 1985, 55, 2130–2131. In the said processes a tungsten anode is dissolved by anodic oxidation in an alcoholic electrolyte solution according to reaction equation (1).

$$W+6ROH \rightarrow W(OR)_6+3H_2 \quad (1)$$

Suitable reactors for carrying out the process according to the invention can be furnaces having a controlled atmosphere or even gas phase reactors. Since the metal alkoxide compounds according to the invention can all easily be brought into the gas phase, a gas phase reactor according to German Patent Application 4 214 720 is also suitable. The selection of the reactor is determined by the demands made in each case as regards particle fineness and particle size distribution of the metal powder.

The present invention is explained in more detail below by means of several examples, without limitations on obvious variations of the procedure. First, the synthesis is described of several tungsten alkoxides which are suitable for carrying out the present invention (preliminary tests 1 and 2).

Preliminary test 1

Electrochemical preparation of tungsten(VI) methoxide

A 0.5 molar solution of LiCl in methanol was electrolysed under argon as protective gas in a reaction vessel equipped with a steel cathode, a tungsten anode and a reflux condenser. Electrolysis was carried out using direct current and a current density of 200 mA/cm$^2$. The solution of electrolyte turned yellowish-orange and began to boil shortly after electrolysis had commenced.

Following electrolysis the excess methanol was drawn off under vacuum at room temperature. The dry residue was taken up in hexane, quickly brought to the boil under reflux, and separated from the undissolved portion over a reversible fritted glass filter. The filtrate was distilled. After removal of the hexane, $W(OCH_3)_6$ boils at ~90° C./0.5 mbar. The compound is colorless and freezes at 50° C.

Elemental analysis: W, found 48.3%, calculated 49.7%; C, found 19.6%, calculated 19 5%; H, found 4.7%, calculated 4.9%; Cl, found 22 ppm.

Preliminary test 2

Electrochemical preparation of tantalum methoxide

A solution of 50 g of $NH_4Cl$ in 2000 ml of methanol was electrolysed under argon as protective gas in a surface-ground reaction vessel equipped with a steel cathode, a tantalum anode and a reflux condenser. Electrolysis was carried out using direct current and a current density of 200 mA/cm$^2$. The solution of electrolyte turned yellowish and began to boil shortly after electrolysis had commenced.

Following electrolysis the excess methanol was drawn off under vacuum at room temperature. The dry residue was taken up in hexane, quickly brought to boil under reflux, and separated from the undissolved portion over a reversible fritted glass filter. The filtrate was distilled. After removal of hexane, $Ta(OCH_3)_5$ boils at ~130° C. in a vacuum (0.3 mbar). The compound is colorless and freezes at about 50° C.

Elemental analysis: Ta, found 50.2%, calculated 53.8%; C, found 17.9% calculated 17.9%; H, found 4.6%, calculated 4.5%; Cl, found 19 ppm.

EXAMPLE 1

Preparation of tungsten powder

Electrochemically prepared tungsten methoxide is purified by sublimation in a glass apparatus and then reacted with hydrogen in a tube furnace at 1000° C. Equation (2).

$$W(OCH_3)_6+3H_2 \rightarrow W+6CH_3OH \quad (2)$$

The tungsten metal powder was analysed for impurities using GDMS (glow-discharge mass spectroscopy).

TABLE 2

Analysis of the tungsten metal powder, values in ppm.

| | | | | | | | | | |
|---|---|---|---|---|---|---|---|---|---|
| Al | 1 | B | <0.05 | Ba | 0.09 | Bi | <0.02 | Ca | 0.34 |
| Cd | <0.05 | Co | 0.08 | Cr | 0.26 | Cu | 0.06 | Fe | 0.31 |
| K | <0.05 | Mg | 5 | Mn | 0.015 | Mo | 6 | Na | 0.2 |
| Ni | 0.12 | P | 0.19 | Pb | 0.03 | Sb | <0.05 | Si | 9 |
| Sn | <0.05 | Sr | <0.02 | Th | <0.0005 | Ti | 0.48 | U | <0.0005 |
| V | <0.02 | Zn | <0.02 | Zr | <0.05 | | | | |

EXAMPLE 2

Preparation of tantalum powder

Electrochemically prepared tantalum methoxide is purified by distillation at 130° C. in a vacuum (0.3 mbar) in a glass apparatus and then reacted with hydrogen in a tube furnace at 1000° C. Equation (3).

$$Ta(OCH_3)_5+2\tfrac{1}{2}H_2 \rightarrow Ta+5CH_3OH \quad (3)$$

The tantalum metal powder was analysed for impurities using GDMS (glow-discharge mass spectroscopy).

TABLE 3

Analysis of the tantalum metal powder, values in ppm.

| | | | | | | | | | |
|---|---|---|---|---|---|---|---|---|---|
| Al | 0.5 | B | <0.05 | Ba | 0.09 | Bi | <0.02 | Ca | 0.4 |
| Cd | <0.05 | Co | 0.05 | Cr | 0.04 | Cu | 0.06 | Fe | 0.2 |
| K | <0.05 | Mg | 3 | Mn | 0.01 | Mo | 0.9 | Na | 0.4 |
| Nb | 8 | Ni | 0.15 | P | 0.1 | Pb | 0.03 | Sb | <0.05 |
| Si | 7 | Sn | <0.05 | Sr | <0.02 | Th | <0.0005 | Ti | 0.6 |
| U | <0.0005 | V | <0.02 | Zn | <0.02 | Zr | <0.05 | | |

EXAMPLE 3

Preparation of titanium powder

Electrochemically prepared titanium ethoxide is purified by distillation at 104° C. in a vacuum (0.3 mbar) in a glass apparatus and then reacted with hydrogen in a tube furnace at 1000° C. Equation (4).

$$Ti(OC_2H_5)_4+2H_2 \rightarrow Ti+4CH_3OH \quad (4)$$

The titanium metal powder was analysed for impurities using GDMS (glow-discharge mass spectroscopy).

TABLE 4

Analysis of the titanium metal powder, values in ppm.

| | | | | | | | | | |
|---|---|---|---|---|---|---|---|---|---|
| Al | 2 | B | <0.05 | Ba | 0.5 | Bi | <0.02 | Ca | 0.2 |
| Cd | <0.05 | Co | 0.25 | Cr | 0.15 | Cu | 0.06 | Fe | 0.4 |
| K | <0.05 | Mg | 3 | Mn | 0.01 | Mo | 4 | Na | 0.3 |
| Nb | 0.25 | Ni | 0.15 | P | 0.2 | Pb | 0.02 | Sb | <0.05 |
| Si | 6.5 | Sn | <0.05 | Sr | <0.02 | Th | <0.0005 | U | <0.0005 |
| V | <0.02 | Zn | <0.02 | Zr | 6 | | | | |

I claim:

1. Process for preparing high purity powder of a metal M selected from the group consisting of tungsten and tantalum by reacting a gas phase methoxide compound of metal M with a reducing gas.

2. Process according to claim 1 wherein the reducing gas is hydrogen.

3. Process according to either of claims 1 or 2 wherein the reducing gas is rarefied by an inert carrier gas which is selected from the group consisting of rare gasses.

4. Process according to claim 3 wherein the carrier gas is argon.

5. Process according to either of claims 1 or 2 wherein the reaction is carried out between 400° and 1,400° C.

6. Process according to claim 5 wherein the reaction is carried out between 600° and 1,200° C.

7. Process for preparing high purity powder of a metal selected from the group consisting of tantalum and tungsten, comprising: (a) purifying one or more alkoxide compounds of the metal by a method selected from the group consisting of distillation and sublimation, and (b) reacting said one or more alkoxide compounds of the metal in the gas phase with a reducing gas.

8. Process for preparing high purity powder of a metal selected from the group consisting of tantalum and tungsten, comprising: (a) purifying one or more methoxide compounds selected from the group consisting of tungsten methoxide and tantalum methoxide by a method selected from the group consisting of distillation and sublimation, and (b) reacting said one or more methoxide compounds in the gas phase with a reducing gas.

9. Process according to either of claims 7 or 8, characterized in that the reducing gas used is hydrogen.

10. Process according to either of claims 7 or 8, characterized in that the reducing gas is rarefied by means of an inert carrier gas selected from the group consisting of the rare gases.

11. Process according to claim 10, characterized in that the carrier gas is argon.

* * * * *